US006632254B1

(12) United States Patent
Bell

(10) Patent No.: US 6,632,254 B1
(45) **Date of Patent: *Oct. 14, 2003**

(54) TREATMENT OF DYED NYLON FIBERS TO PREVENT DEGRADATION CAUSED BY ULTRAVIOLET LIGHT

(75) Inventor: Michael E. Bell, Lexington, VA (US)

(73) Assignee: Burlington Industries, Inc., Greensboro, NC (US)

( * ) Notice: Subject to any disclaimer, the term of this patent is extended or adjusted under 35 U.S.C. 154(b) by 23 days.

This patent is subject to a terminal disclaimer.

(21) Appl. No.: 09/662,113

(22) Filed: Sep. 14, 2000

Related U.S. Application Data

(63) Continuation-in-part of application No. 09/311,639, filed on May 14, 1999, now Pat. No. 6,120,559.

(51) Int. Cl.[7] ..... D06P 5/02; D06P 1/38; D06P 3/24

(52) U.S. Cl. ..... 8/442; 8/543; 8/490; 8/929; 8/924; 8/529

(58) Field of Search ..... 8/442, 543, 490, 8/929, 924, 529

(56) References Cited

U.S. PATENT DOCUMENTS 5,972,046 A * 10/1999 Hixson et al. ..... 8/539

* cited by examiner

*Primary Examiner*—Yogendra N. Gupta
*Assistant Examiner*—Eisa Elhilo
(74) *Attorney, Agent, or Firm*—Nixon & Vanderhye P.C.

(57) ABSTRACT

The effects of ultraviolet induced damage to cationic dyeable nylon fibers dyed at a pH of about 2.5 or less with an acid dye, a premetallized acid dye or a reactive dye are arrested or attenuated by applying to the dyed fibers either before of after exposure to ultraviolet light a neutralizing aqueous solution having a pH of about 7.5 or greater and heating the fibers.

17 Claims, No Drawings

TREATMENT OF DYED NYLON FIBERS TO PREVENT DEGRADATION CAUSED BY ULTRAVIOLET LIGHT

This application is a continuation-in-part of earlier application, Ser. No. 09/311,639, filed May 14, 1999, now U.S. Pat. No. 6,120,559.

This invention relates to processing nylon fibers that have been previously dyed under low pH conditions to render the dyed nylon fiber resistant to the degradation effects of ultraviolet light.

BACKGROUND OF THE INVENTION

Nylon fibers are widely used for tufting into carpets and of such fibers the cationic-dyeable nylons are preferred for their innate ability to resist the effects of stains, particularly acid-based stains from food and the like. In order to provide a full range of shades while maintaining the desired resistance to acid staining, cationic dyeable nylon fibers have been dyed with acid or premetallized acid dyes under low pH conditions, such as pH 2.5 and lower as described in Jenkins U.S. Pat. Nos. 5,466,527; 5,571,290; 5,199,958; 5,354,342; 5,914,409 and 6,013,111 and Boyes U.S. Pat. No. 5,626,362 or with fiber reactive dyes as in Hixson U.S. Pat. No. 5,445,653 (the disclosures of these patents are hereby incorporated by reference). A major end use for nylon fibers dyed under such conditions is in commercial and residential carpet in which the nylon carpet yarns are exposed to a range of challenges including exposure to ultraviolet light. While these patents describe procedures for dyeing cationic dyeable nylon with anionic dyes under various pH conditions all less than neutral, nylon fibers dyed at about pH 2.5 or below are particularly vulnerable to the effects of ultraviolet light.

It has been observed that nylon carpet fibers dyed under low pH conditions are apt to degrade as a consequence of loss in strength and elongation resulting from exposure to ultraviolet light. Degradation is particularly notable when cationic dyeable acid dyed fibers are mixed with acid dyeable nylon fibers.

Nylon carpet yarns which were dyed at a pH of 2.5 or lower exhibit a significantly greater loss of tensile strength and elongation when exposed to ultraviolet radiation such as that found in fluorescent lighting, than the same yarns which were dyed at higher pH values. For carpets containing both, those dyed at low pH break and disintegrate with normal wear while those dyed at higher pH maintain their integrity.

Prior application Ser. No. 09/311,639, now U.S. Pat. No. 6,120,559, relates to the use of neutralizing solutions having a pH of 7.5 or higher applied to cationic dyeable nylon carpet fibers dyed with an acid dye or a premetallized acid dye or a reactive dye at pH of about 2.5 or less to arrest or attenuate ultraviolet induced damage. While the process of using a neutralizing aqueous solution having a pH of about 7.5 or greater attenuates or reduces ultraviolet induced damage, it has now been found that improved results in terms of reducing fiber degradation, as measured by increased fiber tenacity, are obtained when the neutralization process is accompanied by the presence of heat, such as steam. Heating allows the neutralization to be accomplished in a shorter time and surprisingly actually improves fiber tenacity often approximating that of cationic dyeable nylon fibers dyed at a much higher pH, such as pH 6.

DESCRIPTION OF THE INVENTION

It has been discovered that cationic dyeable nylon carpet yarns dyed at low pH can be given a neutralization treatment with an alkaline solution in combination with heat energy, such as in the form of steam, prior to exposure to ultraviolet radiation, which significantly reduces the loss in strength and elongation. It has also been discovered that neutralization in combination with heat after short ultraviolet exposure prevents further degradation of such yarns, as long as the alkaline treatment is controlled to prevent adverse effects on the dyes and desired color. Neutralization after exposure to ultraviolet light is particularly convenient as an after treatment, that is after the nylon yarns have been dyed, but without the preventive neutralizing treatment, and have been installed and are in use such as in residential and commercial carpeting. Treatment after installation allows remedial action after partial damage and degradation have been detected thereby avoiding removal and re-installation or replacement.

This invention provides a process for preventing or reducing ultraviolet light induced degradation of cationic dyeable nylon carpet fibers dyed under acid conditions of about pH 6.0 and in particular about pH 2.5 or less by subjecting the dyed fibers to conditions of about pH 7.5 or above to neutralize the nylon fibers while heating the fibers with a heat source such as steam or the like to render them resistant to or exhibiting reduced degradation, loss in strength and elongation.

Also disclosed is an improved process of dyeing cationic dyeable nylon with an acid dye, a premetallized acid dye or a fiber reactive acid dye at a pH of about 2.5 or less, the improvement including preventing or reducing ultraviolet light induced degradation of the dyed nylon fibers, comprising subjecting the dyed fibers to neutralizing conditions and heating/steaming the fibers. Preferably the dyed nylon fibers are treated with a neutralizing aqueous solution of at least about pH 7.5 then steamed.

Another embodiment of the invention is a process for arresting or attenuating ultraviolet induced damage to nylon fibers comprising subjecting cationic dyeable nylon fibers, dyed at a pH of about 2.5 or less and subsequently exposed to fiber damaging amounts of ultraviolet light, to a neutralizing aqueous solution having a pH of about 7.5 or greater together with heat such as steam thereby arresting ultraviolet induced damage to said nylon fibers. The fibers may be in a carpet to which the aqueous solution is applied.

Disclosed is a process for reducing or preventing ultraviolet light induced degradation of cationic dyeable nylon carpet fibers dyed at a pH of 2.5 or less by subjecting these fibers to pH conditions of at least about pH 7.5, preferably pH 9 to pH 11, and heating the fibers while under neutralization conditions. The process may be conducted at various stages of carpet fabrication subsequent to the low pH dyeing, for instance by subjecting the nylon yarn to neutralizing conditions such as an aqueous alkaline solution, after the dyed yarns are tufted into carpet or subsequent to carpet construction and even after installation. Installed carpet may be treated by heating the aqueous neutralizing solution and applying it via hot water extraction or with steamers that are used in the trade to remove bubbles in installed carpet.

Degradation can be halted or slowed significantly by the application of various alkaline materials such as sodium sulfide, sodium sulfate, sodium bicarbonate, sodium carbonate, sodium thiosulfate, monosodium phosphate and trisodium phosphate in combination with the use of heat. Other materials may be similarly suited to the process. Sodium carbonate and sodium bicarbonate are preferred as they appear to yield the most consistent results. Concentrations of 6.4% and 5% respectively, were applied at a wet pick-up of at least 250% via extraction cleaner but not extracted immediately. This application can be with the alkaline solution at elevated temperature, i.e., hot water extraction cleaner sometimes referred to as "steam cleaning." Steam can be then applied and maintained. Exposure time to the neutralizing solution and heat may be as short as 1 to 2 minutes, or longer, followed by air drying.

Prior to drying, yarn or carpet dyed at a low pH could be rinsed with a solution of the alkaline materials. This rinse may require total saturation of the substrate. This rinse can be at elevated temperature or followed by heating (via steam) before rinsing. Concentration of the alkaline material may be related to the molar equivalent of acidic material still present in the substrate, or the pH attributed to that material. If possible, this alkaline rinse may be the last step before drying, i.e. no water rinse, if the alkaline condition does not adversely affect the quality of the substrate, both esthetically and physically. A further water rinse may be advisable to reduce or remove residuals. Very high pH can affect shade or fastness, and proper application of subsequent finishes such as fluorochemicals, thus the specific pH and other treating conditions will be adjusted to avoid unwanted results.

Application before drying is preferred. If this is not possible, treatment of dry material with the above-noted alkaline materials would be effective but may require surface active agents to obtain thorough wetting of the substrate.

The invention is further explained with reference to the following non-limiting examples:

In a continuous dyeing process cationic dyeable nylon fibers were dyed three light shades using a variety of pre-metallized dyes at a very low pH, less than 2. A control for each shade was dyed at pH 6.0. Four test samples were dyed at pH 1.8 and subjected to various alkaline aftertreatments to simulate rinse processes available in a typical production operation. Results were as shown in Table 1.

TABLE 1

| | Tenacity (grams/denier; ASTM D 2256) @ 80 hours (AATCC TM-16E) | | |
|---|---|---|---|
| Process | GOLD | BEIGE | GREEN |
| Dyed at pH 6.0 | 2.97 | 2.94 | 2.93 |
| Dyed at pH 1.8, sodium bicarbonate aftertreatment {pH 10.0}, contact time < 5 seconds | 1.06 | 1.13 | 0.98 |
| Dyed at pH 1.8, sodium bicarbonate aftertreatment {pH 10.0}, contact time 20 seconds | 1.09 | 1.10 | 1.05 |
| Dyed at pH 1.9, sodium bicarbonate aftertreatment {pH 10.0}, contact time < 5 seconds | 0.80 | 1.12 | 0.81 |
| Dyed at pH 1.8, sodium bicarbonate aftertreatment {pH 10.0}, contact time 20 seconds | 0.93 | 1.12 | 1.03 |

These results were not particularly satisfactory considering the observed reduction in tenacity. Next a steam step was included. Only one light shade was tested, along with a dark olive shade. These results are shown in Table II. The energy from the steaming plus the longer contact time with the alkaline solution are quite evident as indicated by increased tenacity values approaching those of the controls dyed at pH 6.0.

TABLE II

| | Tenacity (grams/denier, ASTM D2256) @ two exposure levels (AATCC TM-16E) | | | |
|---|---|---|---|---|
| | 80 hours | | 160 hours | |
| Process | GOLD | OLIVE | GOLD | OLIVE |
| Dyed at pH 1.8, sodium bicarbonate aftertreatment {pH 10.0}, steam 1.5 minutes | 2.96 | 2.96 | 3.0 | 2.89 |
| Dyed at pH 1.8, sodium bicarbonate aftertreatment {pH 10.0}, no steam hold 1.5 minutes | 2.74 | 2.82 | 2.41 | 2.79 |
| Dyed at pH 1.8, sodium carbonate aftertreatment {pH 10.0}, steam 1.5 minutes | 2.67 | 2.78 | 2.70 | 2.85 |
| Dyed at pH 1.8, sodium carbonate aftertreatment {pH 10.0}, no steam hold 1.5 minutes | 2.78 | 2.78 | 2.74 | 2.89 |
| Dyed at pH 1.8, steam 1.5 minutes | 2.41 | 2.82 | 1.85 | 2.79 |

In contrast to the continuous dyeing process used above, using an exhaust process, the same three colors as used above were also dyed. The aftertreatments were performed cold, that is at room temperature. Due to the logistics of performing this test, the specimens were in contact with the alkaline solutions for about 5 minutes.

It was curious to note the pH 6.0 dyeing sample had less strength than its continuous dyed counterpart, but the aftertreatments yielded more tenacity retention. Results are shown in Table III. These results, namely lower strength for exhaust dyeing at pH 6.0 vs. continuous dyeing at pH 6.0, (compare the results of Table III with those of Table I may indicate any prolonged contact at acidic pH weakens nylon yarn whether weakly acidic or strongly acidic even dyeing at acidic pH. The improved results for the ater treatments in Table III versus Table I also indicate that extended time (5 minutes versus 5–20 seconds) reduces the effect of the low pH dyeing.

TABLE III

| | Tenacity (grams/denier; ASTM D2256) @ 80 hours (AATCC TM-16E) | | |
|---|---|---|---|
| Process | GOLD | BEIGE | GREEN |
| Dyed at pH 6.0 | 2.16 | 2.41 | 2.56 |
| Dyed at pH 1.8, | 0.63 | 1.06 | 0.90 |
| Dyed at pH 1.8, sodium bicarbonate aftertreatment {pH 10.0}, 5 minutes | 1.61 | 1.82 | 1.82 |
| Dyed at pH 1.8, sodium carbonate aftertreatment {pH 10.0} 5 minutes | 1.15 | 1.48 | 1.60 |

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for arresting or attenuating ultraviolet induced damage to nylon fibers comprising:

dyeing cationic dyeable nylon fibers at a pH of about 2.5 or less with an acid dye, a premetallized acid dye or a reactive dye; and subsequent to exposing said fibers to fiber damaging amounts of ultraviolet light, applying a neutralizing aqueous solution having a pH of about 7.5 or greater to said fibers and heating the fibers, thereby arresting or attenuating ultraviolet induced damage to said nylon fibers.

2. The process of claim 1 wherein the dye is an acid dye.

3. The process of claim 1 wherein the dye is a premetallized acid dye.

4. The process of claim 1 wherein the dye is a reactive dye.

5. A method for arresting or attenuating ultraviolet induced damage to cationic dyeable nylon fibers, which have been dyed at a pH of about 2.5 or less with an acid dye, a premetallized acid dye or a fiber reactive dye, after installation of a carpet containing said fibers, the process comprising the steps of:

subsequent to exposing the fibers of the installed and dyed carpet to fiber damaging amounts of ultraviolet light, applying heat and a neutralizing aqueous solution having a pH of about 7.5 or greater to said fibers in the installed carpet thereby arresting or attenuating ultraviolet induced damage to the nylon fibers of the installed carpet.

6. The process of claim 5 wherein the dye is an acid dye.

7. The process of claim 5 wherein the dye is a premetallized acid dye.

8. The process of claim 5 wherein the dye is a reactive dye.

9. A process for arresting or attenuating ultraviolet induced damage to nylon fibers comprising:

dyeing cationic dyeable nylon fibers at a pH of about 6.0 or less with an acid dye, a premetallized acid dye or a reactive dye for a time sufficient to reduce the tenacity of the cationic dyeable nylon fibers; and subsequent to exposing said fibers to fiber damaging amounts of ultraviolet light, applying a neutralizing aqueous solution having a pH of about 7.5 or greater to said fibers and heating the fibers, thereby arresting or attenuating ultraviolet induced damage to said nylon fibers.

10. The process of claim 9 wherein the dye is an acid dye.

11. The process of claim 9 wherein the dye is a premetallized acid dye.

12. The process of claim 9 wherein the dye is a reactive dye.

13. A method for arresting or attenuating ultraviolet induced damage to cationic dyeable nylon fibers, which have been dyed at a pH of about 6.0 or less with an acid dye, a premetallized acid dye or a fiber reactive dye for a time sufficient to reduce the tenacity of the cationic dyeble nylon fibers, after installation of a carpet containing said fibers, the process comprising the steps of:

subsequent to exposing the fibers of the installed and dyed carpet to fiber damaging amounts of ultraviolet light, applying heat and a neutralizing aqueous solution having a pH of about 7.5 or greater to said fibers in the installed carpet thereby arresting or attenuating ultraviolet induced damage to the nylon fibers of the installed carpet.

14. The process of claim 13 wherein the dye is an acid dye.

15. The process of claim 13 wherein the dye is a premetallized acid dye.

16. The process of claim 13 wherein the dye is a reactive dye.

17. The process of claim 13 wherein the aqueous solution is applied to the carpet or yarns for a period of at least 5 minutes.

* * * * *